US008896407B2

(12) United States Patent
Chatani et al.

(10) Patent No.: US 8,896,407 B2
(45) Date of Patent: Nov. 25, 2014

(54) INDUCTOR

(71) Applicant: NEC TOKIN Corporation, Sandai-shi, Miyagi (JP)

(72) Inventors: Kenichi Chatani, Sendai (JP); Naoharu Yamamoto, Sendai (JP)

(73) Assignee: NEC TOKIN Corporation, Sendai-shi, Miyagi (JP)

( * ) Notice: Subject to any disclaimer, the term of this patent is extended or adjusted under 35 U.S.C. 154(b) by 38 days.

(21) Appl. No.: 13/676,574

(22) Filed: Nov. 14, 2012

(65) Prior Publication Data

US 2013/0120098 A1 May 16, 2013

(30) Foreign Application Priority Data

Nov. 16, 2011 (JP) ..... 2011-250663

(51) Int. Cl.

| | |
|---|---|
| ***H01F 27/24*** | (2006.01) |
| ***H01F 17/04*** | (2006.01) |
| ***H01F 27/30*** | (2006.01) |
| ***H01F 3/08*** | (2006.01) |
| ***H01F 27/26*** | (2006.01) |

(52) U.S. Cl.

CPC ..... *H01F 3/08* (2013.01); *H01F 17/04* (2013.01); *H01F 27/263* (2013.01)

USPC ..... 336/212; 336/233; 336/213; 336/221; 336/218; 336/196

(58) Field of Classification Search

CPC ..... H01F 27/263; H01F 27/306; H01F 3/14; H01F 3/10; H01F 37/00

USPC ..... 336/212, 233, 221, 214, 218, 213

See application file for complete search history.

(56) References Cited

U.S. PATENT DOCUMENTS

| | | | | | |
|---|---|---|---|---|---|
| 3,745,499 | A * | 7/1973 | Smith | 336/160 |
| 5,062,197 | A * | 11/1991 | Ngo et al. | 29/606 |
| 5,912,609 | A * | 6/1999 | Usui et al. | 336/83 |
| 2009/0231077 | A1* | 9/2009 | Liao et al. | 336/177 |
| 2010/0182117 | A1* | 7/2010 | Wu et al. | 336/192 |
| 2010/0255282 | A1* | 10/2010 | Hong et al. | 428/222 |
| 2010/0321143 | A1* | 12/2010 | Satake et al. | 336/192 |
| 2011/0001601 | A1* | 1/2011 | Lo | 336/212 |
| 2012/0299686 | A1* | 11/2012 | Matsuda et al. | 336/212 |
| 2013/0002383 | A1* | 1/2013 | Esaki et al. | 336/90 |

FOREIGN PATENT DOCUMENTS

| | | | |
|---|---|---|---|
| JP | 11-176680 | A | 7/1999 |
| JP | 2007-67214 | A | 3/2007 |
| JP | 2008-66671 | A | 3/2008 |
| JP | 2008-181923 | A | 8/2008 |
| JP | WO 2011/111257 | * | 9/2011 |
| JP | WO 2011/118508 | * | 9/2011 |

* cited by examiner

*Primary Examiner* — Alexander Talpalatski
*Assistant Examiner* — Kazi Hossain
(74) *Attorney, Agent, or Firm* — Holtz, Holtz, Goodman & Chick PC

(57) ABSTRACT

An inductor comprises a magnetic core and a coil. The magnetic core has a wound portion around which the coil is wound, and a peripheral portion. The magnetic core is formed from two or more preliminarily-formed-bodies which are pressure-molded in a state where the coil winds one or more preliminarily-formed-bodies which form the wound portion. The preliminarily-formed-bodies include at least one preliminarily-formed-body which forms the peripheral portion while not form the wound portion. Each of the preliminarily-formed-bodies is made of a mixture of flat magnetic powders and an organic binder so as to have a plate-like shape. The flat magnetic powders are oriented so as to be parallel to the preliminarily-formed-body.

10 Claims, 6 Drawing Sheets

INDUCTOR

CROSS REFERENCE TO RELATED APPLICATIONS

Applicants claim priority under 35 U.S.C. §119 of Japanese Patent Applications No. JP2011-250663 filed Nov. 16, 2011.

BACKGROUND OF THE INVENTION

This invention relates to an inductor comprising a magnetic core made of flat magnetic powders and a coil wound around the magnetic core, wherein the magnetic core and the coil are integrally pressure-molded. For example, this invention is applicable to an inductor component which is used in a power supply circuit of an electronic device having a reduced size.

The miniaturization of an electronic device requires an inductor to have not only a sufficient performance but also a low-profile. For example, a low-profile inductor (i.e. a thin inductor) is disclosed or suggested in each of JP-A 2007-67214, JP-A 2008-66671, JP-A 2008-181923 and JP-A H11 (1999)-176680, contents of which are incorporated herein by reference.

The power inductor (the inductor) disclosed in JP-A 2007-67214 comprises an insulating body (a magnetic core) and a coiled conductor (a coil). The magnetic core has a plate-like shape which is thin in an upper-to-lower direction. The coil is formed within the magnetic core. The coil has a central axis extending in the upper-to-lower direction.

The magnetic substrate (the inductor) disclosed in JP-A 2008-66671 comprises a magnetic core formed from a plurality of thin sheets laminated in an upper-to-lower direction. The magnetic core has a through hole which pierces the magnetic core in the upper-to-lower direction. The magnetic substrate further comprises a plating seed layer. The plating seed layer is formed on an outer surface of the magnetic core and an inner surface of the through hole so that the magnetic substrate is formed with a coiled conductor (a coil) having a central axis extending in parallel to the outer surface of the magnetic core.

The inductor disclosed in JP-A 2008-181923 comprises a magnetic core and a coiled wire (a coil). The magnetic core is made of flat particles (flat magnetic powders). The magnetic core has an upper surface perpendicular to an upper-to-lower direction, and a through hole piercing the magnetic core in the upper-to-lower direction. The coil is wound around a part of the magnetic core so as to pass through the through hole. Accordingly, the coil has a central axis extending in parallel to the upper surface of the magnetic core.

The magnetic core disclosed in JP-A H11 (1999)-176680 is formed from a plurality of thin sheets each made of soft magnetic metal powders (flat magnetic powders). The thin sheets are pressure-molded in a state where the thin sheets are stacked in an upper-to-lower direction. The magnetic core is stamped out from the pressure-molded thin sheets so as to have a toroidal shape.

The central axis of the coil of the inductor of JP-A 2007-67214 is perpendicular to the plate-like shape of the inductor. Accordingly, the inductor is excited in the upper-to-lower direction. However, the inductor is thin in the upper-to-lower direction. It is therefore difficult to improve the effective permeability because of the influence of the diamagnetic field. In other words, it is difficult to obtain a large inductance when the inductor becomes thin.

Complicated processes are required to form the inductor of JP-A 2008-66671. Moreover, the coil of JP-A 2008-66671 is formed by an electroplating. Accordingly, the time for the plating process becomes longer as the cross-section of the coil becomes larger. It is therefore difficult to reduce a direct current resistance as compared with an inductor formed by a general winding process.

The coil of the inductor of JP-A 2008-181923 is wound around the pressure-molded magnetic core. Similarly, when an inductor is made from the magnetic core of JP-A H11 (1999)-176680, it is necessary to wind a coil around the pressure-molded magnetic core. In other words, when the inductor is made by using the magnetic core disclosed in JP-A 2008-181923 or JP-A H11 (1999)-176680, it is necessary to wind the coil after the magnetic core is completely formed. When the magnetic core has a reduced size, the coil is required to pass through the small through hole. Accordingly, it is difficult to form the inductor.

SUMMARY OF THE INVENTION

It is therefore an object of the present invention to provide an inductor which is able to have a low-profile in addition to a sufficient performance while being formable more easily.

One aspect of the present invention provides an inductor comprising a magnetic core and a coil. The magnetic core has a wound portion and a peripheral portion. The magnetic core is formed by pressure-molding two or more preliminarily-formed-bodies each having a plate-like shape parallel to a predetermined plane. The preliminarily-formed-bodies include at least one first preliminarily-formed-body which forms the wound portion and at least one second preliminarily-formed-body which forms the peripheral portion. At least one of the second preliminarily-formed-bodies is other than the first preliminarily-formed-body. Each of the preliminarily-formed-bodies is formed from a mixture of flat magnetic powders and an organic binder. The flat magnetic powders are oriented so as to be parallel to the predetermined plane. The coil is wound around the wound portion. The preliminarily-formed-bodies are pressure-molded in a state where the coil is wound around the first preliminarily-formed-bodies which form the wound portion.

An appreciation of the objectives of the present invention and a more complete understanding of its structure may be had by studying the following description of the preferred embodiment and by referring to the accompanying drawings.

Figure 1:
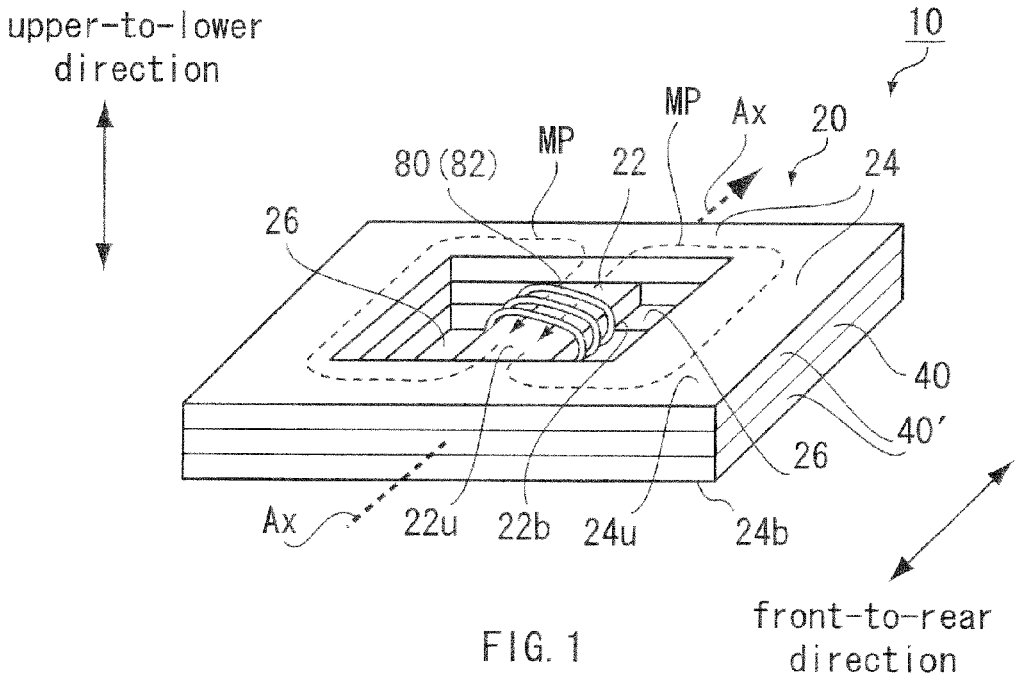
FIG. 1 is a perspective view showing an inductor according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

A First Embodiment

As shown in FIG. 1, an inductor 10 according to a first embodiment of the present invention comprises a magnetic core 20 and a coil 80. The magnetic core 20 has a plate-like shape which is thin in an upper-to-lower direction. The magnetic core 20 has a wound portion 22 around which the coil 80 is wound, a peripheral portion 24 other than the wound portion 22, and a through hole 26 which pierces the magnetic core 20 in the upper-to-lower direction. The magnetic core 20 according to the present embodiment is formed with two through holes 26. The two through holes 26 extend in parallel to each other in a front-to-rear direction perpendicular to the upper-to-lower direction. Each of the two through holes 26 is enclosed by the wound portion 22 and the peripheral portion 24 in a plane perpendicular to the upper-to-lower direction. In other words, the wound portion 22 is located between the two through holes 26 so as to extend in the front-to-rear direction.

The wound portion 22 has an upper surface (upper end) 22*u* and a lower surface (lower end) 22*b* each perpendicular to the upper-to-lower direction. Similarly, the peripheral portion 24 has an upper surface 24*u* and a lower surface 24*b* each perpendicular to the upper-to-lower direction (i.e. each parallel to a plane perpendicular to the upper-to-lower direction). According to the present embodiment, the upper surface 24*u* and the lower surface 24*b* of the peripheral portion 24 are an upper surface and a lower surface of the magnetic core 20, respectively. More specifically, the upper surface 22*u* of the wound portion 22 is located below the upper surface 24*u* of the peripheral portion 24. The lower surface 22*b* of the wound portion 22 is located above the lower surface 24*b* of the peripheral portion 24. In other words, the magnetic core 20 according to the present embodiment has a central region which is recessed in the upper-to-lower direction.

The coil 80 is wound around the wound portion 22 so as to have a central axis Ax extending along the front-to-rear direction (i.e. extending in parallel to a plane perpendicular to the upper-to-lower direction). More specifically, the coil 80 is wound around the wound portion 22 so as to sew the two through holes 26. The coil 80 has a winding portion 82 which winds around the wound portion 22 so as to pass through the through holes 26. The coil 80 further has two end portions 84 (see FIG. 2). According to the present embodiment, the winding portion 82 is located between the upper surface 24*u* and the lower surface 24*b* of the peripheral portion 24 in the upper-to-lower direction. The coil 80 according to the present embodiment is a coated flat type copper wire. The flat type copper wire has a relatively large cross-section. Accordingly, it is possible to reduce a direct current resistance. However, the coil 80 may be, for example, a solid copper wire.

Figure 2:
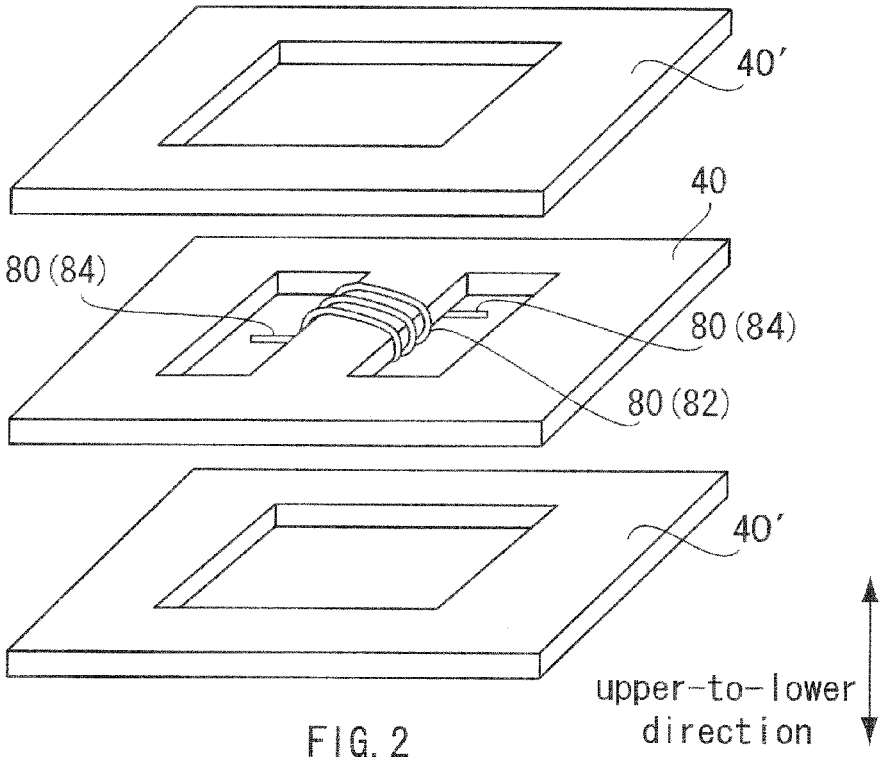
FIG. 2 is a perspective view showing an arrangement of preliminarily-formed-bodies which form the inductor of FIG. 1.

As can be seen from FIGS. 1 and 2, the magnetic core 20 according to the present embodiment is formed from one preliminarily-formed-body (first preliminarily-formed-body) 40 and two preliminarily-formed-bodies (second preliminarily-formed-bodies) 40'. In detail, the two preliminarily-formed-bodies 40' are arranged to interpose the preliminarily-formed-body 40 in the upper-to-lower direction in a state where the coil 80 is wound around the preliminarily-formed-body 40. Then, the preliminarily-formed-body 40 and the preliminarily-formed-bodies 40' are pressure-molded (i.e. pressed and formed) together with the coil 80. In other words, the magnetic core 20 according to the present embodiment is formed by pressure-molding two or more preliminarily-formed-bodies 40 and 40' which are stacked in the upper-to-lower direction. The preliminarily-formed-bodies 40 and 40' are pressure-molded in a state where the coil 80 is wound around the one (or more) preliminarily-formed-body 40. As described above, when the preliminarily-formed-bodies 40 and 40' are pressure-molded, the coil 80 is pressed in a state where the coil 80 is wound around the one or more preliminarily-formed-bodies 40 which form the wound portion 22. In short, the magnetic core 20 and the coil 80 are integrally pressure-molded.

Figure 3A:
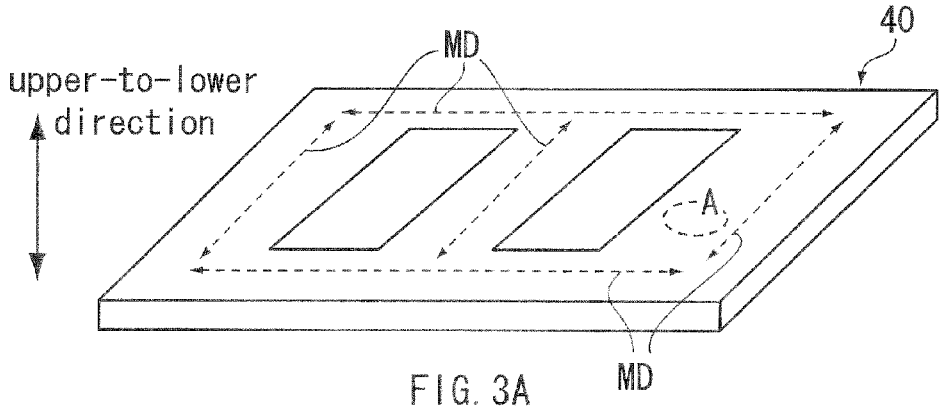
FIG. 3A is a perspective view showing one of the preliminarily-formed-bodies of FIG. 2.
Figure 3B:
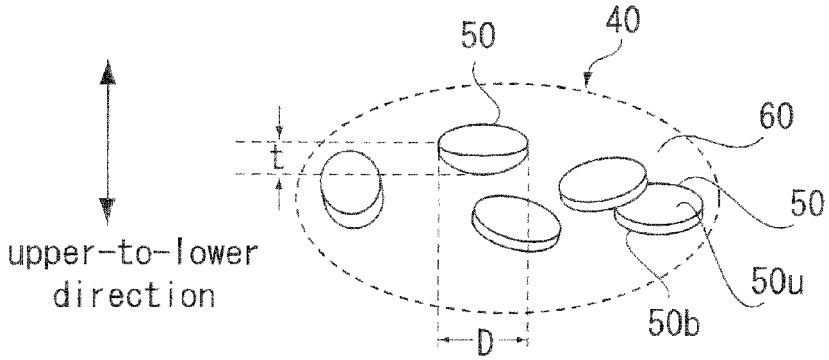
FIG. 3B is a schematic view showing flat magnetic powders contained in a part (a part enclosed by dashed line A in FIG. 3A) of the preliminarily-formed-body of FIG. 3A.

As can be seen from FIGS. 3A and 3B, the preliminarily-formed-body 40 is formed from a mixture of flat metal powders (flat magnetic powders) 50 and an organic binder 60 so as to have a plate-like shape parallel to a plane perpendicular to the upper-to-lower direction. Each of the preliminarily-formed-bodies 40' is formed from the mixture of flat metal powders 50 and the organic binder 60 similar to the preliminarily-formed-body 40 (see FIGS. 2, 3A and 3B).

As schematically shown in FIG. 3B, the flat metal powder 50 has a roughly thin disc-like shape so as to have an upper surface 50*u* and a lower surface 50*b*. In detail, the flat magnetic powder 50 is a metal powder having a flat shape which is flat in the upper-to-lower direction while irregular in a plane perpendicular to the upper-to-lower direction. It is possible to produce thus shaped flat metal powders 50, for example, by forging metal powders. The aforementioned flat metal powders 50 are used as material of the preliminarily-formed-body 40 or 40' so that it is possible to make the magnetic core 20 to have a high saturation magnetic flux density and a high magnetic permeability like ferrite. Moreover, the flat metal powders 50 are bound by the organic binder 60 (i.e. insulating material) so that it is possible to shorten a radius of an eddy current. Accordingly, the magnetic core 20 has a superior frequency characteristic.

It is preferred that the average size of major axes (D) of all the flat metal powders 50 (i.e. the average major axis (Da)) be between 5 μm (including 5 μm) and 200 μm (including 200 μm) so as to obtain the aforementioned properties. Moreover, it is preferred that the average size of maximum thicknesses (t) of all the flat metal powders 50 (i.e. the average maximum thickness (ta)) be between 0.5 μm (including 0.5 μm) and 20 μm (including 20 μm). Moreover, it is preferred that the average value of aspect ratios (D/t) of all the flat metal powders 50 (i.e. the average aspect ratio (Da/ta)) be 10 or more.

As shown in FIGS. 3A and 3B, each of the upper surface 50*u* and the lower surface 50*b* of the flat metal powder 50 is roughly perpendicular to the upper-to-lower direction. In detail, each of the upper surface 50*u* and the lower surface 50*b* is in parallel to or gently crosses a plane perpendicular to the upper-to-lower direction. In other words, the flat metal powders 50 are roughly placed in a plane of the preliminarily-formed-body 40 (i.e. oriented so as to be parallel to a plane perpendicular to the upper-to-lower direction). As described below, it is possible to orient the flat metal powders 50 as described above without placing the flat metal powders 50 in a specific magnetic field. For example, the mixture of the flat metal powders 50 and the organic binder 60 are mixed with a volatile solvent. Then, the volatile solvent which contains the flat metal powders 50 and the organic binder 60 is applied so as to have a thin sheet-like shape. Then, the volatile solvent is volatilized so that the remaining flat metal powders 50 are oriented as described above.

As can be seen from the above description, the flat metal powders 50 are randomly (therefore equally) distributed in a plane perpendicular to the upper-to-lower direction. Accordingly, a direction of easy magnetization (axis of easy magnetization) MD of the preliminarily-formed-body 40 or 40' is perpendicular to the upper-to-lower direction (see FIGS. 2 and 3A). In other words, the preliminarily-formed-body 40 or 40' is easily magnetized in any direction in a plane perpendicular to the upper-to-lower direction. Accordingly, a magnetic path MP, which is generated when a current flows in the coil 80, mostly extends along the axis of easy magnetization MD of the magnetic core 20. It is therefore possible to further increase an inductance of the inductor 10 (see FIGS. 1 and 3A).

As shown in FIGS. 1 and 2, according to the present embodiment, the wound portion 22 is formed from a part of the preliminarily-formed-body 40 while the peripheral portion 24 is formed from another part of the preliminarily-formed-body 40 and the preliminarily-formed-bodies 40'. In other words, the preliminarily-formed-bodies 40 and 40' includes at least one first preliminarily-formed-body (according to the present embodiment, the preliminarily-formed-body 40) which forms the wound portion 22 and at least one second preliminarily-formed-body (according to the present embodiment, the preliminarily-formed-bodies 40 and 40') which forms the peripheral portion 24. At least one of the second preliminarily-formed-bodies (according to the present embodiment, the preliminarily-formed-bodies 40') is other than the first preliminarily-formed-body. According to the present embodiment, the preliminarily-formed-body 40 which constitutes the wound portion 22 is separately formed from the preliminarily-formed-body 40' which constitutes the peripheral portion 24. It is therefore possible to produce the preliminarily-formed-body 40 which forms the wound portion 22 and the preliminarily-formed-body 40' which forms the peripheral portion 24 by using different materials (for example, two kinds of the flat metal powders 50 having different compositions from each other).

The magnetic core 20 is configured as described above so that only the preliminarily-formed-body 40 is able to be pressure-molded before the coil 80 is wound around the preliminarily-formed-body 40. In other words, the wound portion 22 may be formed from the wound-portion forming body (preliminarily-formed-body) 40 which is pressure-molded in advance. The wound-portion forming body 40 may be formed by pressure-molding the first preliminarily-formed-bodies (according to the present embodiment, the preliminarily-formed-body 40) before the coil 80 is wound. If the preliminarily-formed-body 40 is thus pressure-molded in advance, it is possible to prevent the preliminarily-formed-body 40 from being largely deformed when the preliminarily-formed-body 40 around which the coil 80 is wound and the preliminarily-formed-body 40' are stacked to be pressure-molded.

As previously described, according to the present embodiment, the preliminarily-formed-body 40 has a predetermined part which forms the wound portion 22. When the preliminarily-formed-body 40 (which is already pressure-molded) and the preliminarily-formed-bodies 40' are stacked, any one of the preliminarily-formed-bodies 40' is placed neither on nor under the aforementioned predetermined part of the preliminarily-formed-body 40. It is therefore possible to prevent the magnetic performance of the wound portion 22 from being degraded by a pressure when the stacked preliminarily-formed-body 40 and the preliminarily-formed-bodies 40' are pressure-molded. However, the magnetic core 20 may be formed differently. For example, the preliminarily-formed-bodies 40 which are not pressure-molded (i.e. non-pressure-molded-bodies) may be placed on and under the preliminarily-formed-bodies 40 which is pressure-molded in advance (i.e. pre-pressure-molded-bodies). When thus placed non-pressure-molded-bodies and the pre-pressure-molded-bodies are integrally pressure-molded, the central region of the magnetic core 20 may be formed so as to be flush with the peripheral portion 24. The magnetic core 20 may be formed so as to have yet another shape. For example, it is possible to form the central region of the magnetic core 20 so that the central region protrudes from the peripheral portion 24 in the upper-to-lower direction.

When the preliminarily-formed-bodies 40 and 40' are stacked, the through hole 26 may be filled with a magnetic material. For example, the through hole 26 may be filled with a mixed material comprised of metal powders and a binder. The stacked preliminarily-formed-bodies 40 and 40' may be pressure-molded together with the magnetic material which fills the through hole 26. Thus formed inductor 10 has a rectangular shape without a hole. Moreover, the magnetic material covers around the coil 80. It is therefore possible to further improve the inductance of the inductor 10.

As previously described, the preliminarily-formed-body 40 may be pressed in advance. Moreover, the pressed preliminarily-formed-body 40 may be heat-treated at high temperature (for example, 300° C. or more, preferably 400° C. or more). The wound-portion forming body 40 may be thus heat-treated preliminarily-formed-body 40. In other words, the wound-portion forming body 40 may be formed by heat-treating the pressure-molded preliminarily-formed-body 40 at 300° C. or more before the coil 80 is wound. In this case, it is possible to further improve a magnetic permeability of the wound portion 22.

A Second Embodiment

Figure 4:
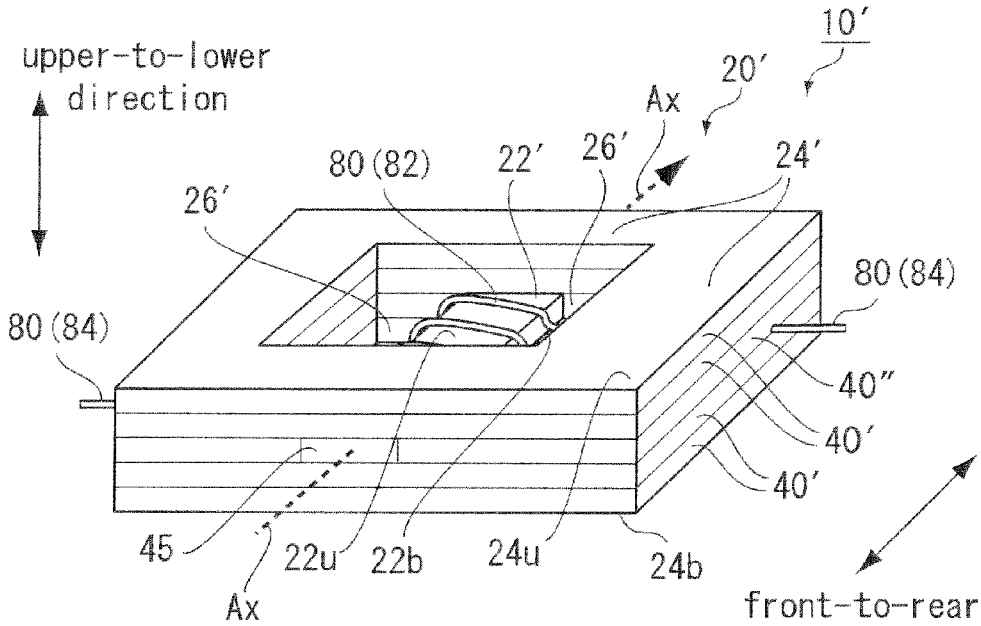
FIG. 4 is a perspective view showing an inductor according to a second embodiment of the present invention.

As shown in FIG. 4, an inductor 10' according to a second embodiment of the present invention has a similar structure to the inductor 10 according to the first embodiment. More specifically, the inductor 10' comprises a magnetic core 20' and a coil 80. The magnetic core 20' is configured similar to the magnetic core 20 according to the first embodiment. In detail, the magnetic core 20' has a plate-like shape which is thin in the upper-to-lower direction. The magnetic core 20' has a wound portion 22' around which the coil 80 is wound, a peripheral portion 24' other than the wound portion 22', and a through hole 26' which pierces the magnetic core 20' in the upper-to-lower direction. The magnetic core 20' according to the present embodiment is formed with two through holes 26'. The two through holes 26' extend in parallel to each other in the front-to-rear direction. Each of the two through holes 26' is enclosed by the wound portion 22' and the peripheral portion 24' in a plane perpendicular to the upper-to-lower direction.

Similar to the first embodiment, the wound portion 22' has the upper surface (upper end) 22*u* and the lower surface (lower end) 22*b* each perpendicular to the upper-to-lower direction. The peripheral portion 24' has the upper surface 24*u* and the lower surface 24*b* each perpendicular to the upper-to-lower direction.

Similar to the first embodiment, the coil 80 passes through the two through holes 26' so as to be wound around the wound portion 22'. Accordingly, the coil 80 has the central axis Ax extending in parallel to a plane perpendicular to the upper-to-lower direction.

Figure 5:
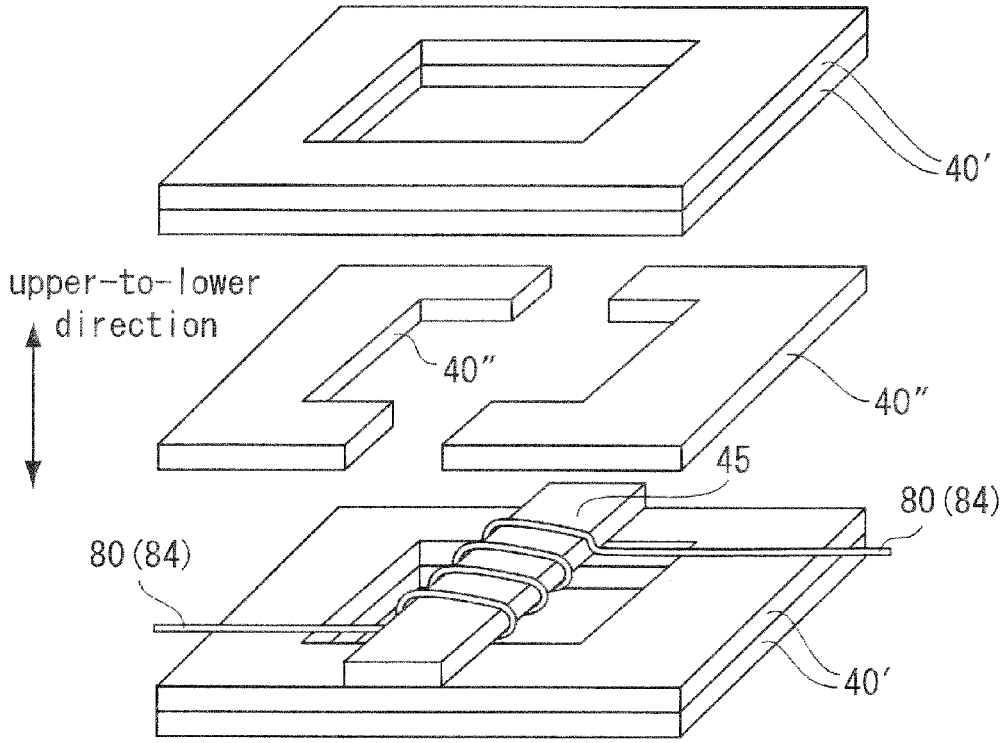
FIG. 5 is a perspective view showing an arrangement of preliminarily-formed-bodies which form the inductor of FIG. 4.
Figure 6:
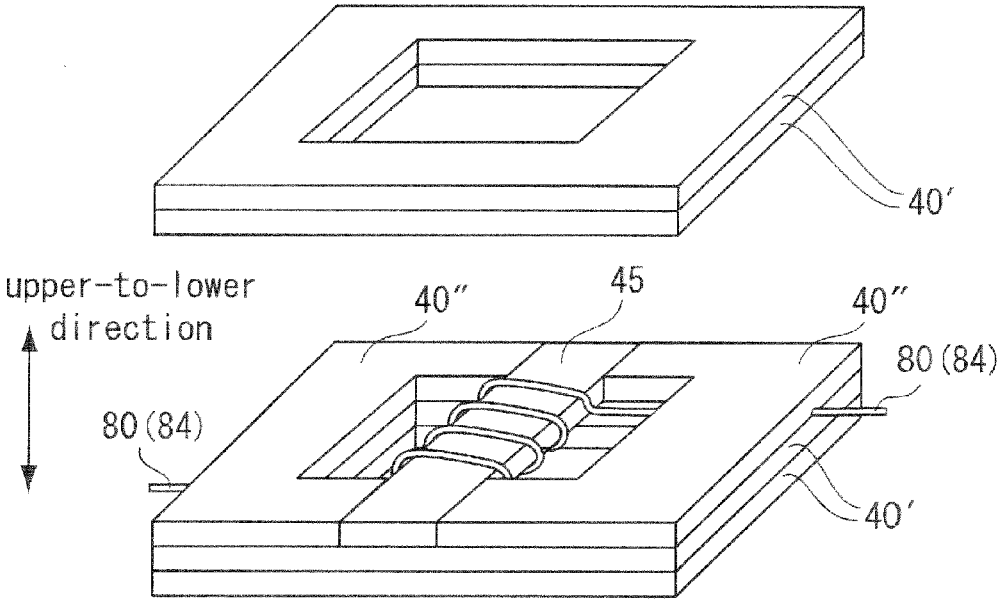
FIG. 6 is another perspective view showing the arrangement of the preliminarily-formed-bodies which form the inductor of FIG. 4.

As can be seen from FIGS. 4 to 6, the magnetic core 20' according to the present embodiment is formed from a (pressed) preliminarily-formed-body (first preliminarily-formed-body) 45, the preliminarily-formed-bodies 40' and preliminarily-formed-bodies (second preliminarily-formed-bodies) 40" each has a plate-like shape. The preliminarily-formed-bodies 45, 40' and 40" are stacked in the upper-to-lower direction in a state where the coil 80 is wound around the preliminarily-formed-body 45. Thus stacked preliminarily-formed-bodies 45, 40' and 40" are pressure-molded so that the magnetic core 20' is formed. Each of the preliminarily-formed-bodies 45 and 40" is formed similar to the preliminarily-formed-body 40' (see FIGS. 3A and 3B). Accordingly, an axis of easy magnetization of the magnetic core 20' extends in a plane perpendicular to the upper-to-lower direction. A magnetic path, which is generated when a current flows in the coil 80, mostly extends along the axis of easy magnetization MD of the magnetic core 20'.

As can be seen from FIGS. 5 and 6, the magnetic core 20' can be produced as described below.

At first, similar to the first embodiment, a plate-like sheet is formed from the mixture of the flat magnetic powders 50 and the thermoset organic binder 60 (see FIGS. 3A and 3B). The preliminarily-formed-bodies 40', 40" and 45 are formed from the aforementioned plate-like sheet. In detail, the preliminarily-formed-body 40' is cut out from the plate-like sheet so as to have a rectangular frame-like shape. Similarly, the preliminarily-formed-body 40" is cut out so as to have a rectangular bracket-like shape. In addition, a piece having a rectangular shape is cut out from the plate-like sheet. The piece is pressure-molded so that the preliminarily-formed-body 45 having a rectangular shape can be formed. The preliminarily-formed-body 45 may be formed from a plurality of the aforementioned pieces each having the rectangular shape. For example, the pieces are pressure-molded after stacked in the upper-to-lower direction so that the preliminarily-formed-body 45 having a predetermined thickness may be formed.

Then, the coil 80 is wound around the preliminarily-formed-body 45. The preliminarily-formed-body 45 may be heat-treated at high temperature (for example, 300° C. or more, preferably 400° C. or more) before the coil 80 is wound.

Then, the preliminarily-formed-body 45 is placed (i.e. stacked) on the preliminarily-formed-bodies 40'. The preliminarily-formed-bodies 40" are placed on the respective sides of the preliminarily-formed-bodies 40' so as to interpose the preliminarily-formed-body 45 in a plane perpendicular to the upper-to-lower direction. As a result, the coil 80 passes between the preliminarily-formed-body 45 and the preliminarily-formed-body 40". Then, the preliminarily-formed-bodies 40' are placed on the preliminarily-formed-body 45 and the preliminarily-formed-body 40". A necessary number of the preliminarily-formed-bodies 40' may be placed so as to have a predetermined thickness after pressure-molded. Similarly, a necessary number of the preliminarily-formed-bodies 40" may be placed so as to have the same thickness to the preliminarily-formed-body 45 after pressure-molded.

Then, thus stacked (i.e. placed) preliminarily-formed-bodies 40', 40" and 45 are pressure-molded so that the inductor 10' is formed (see FIG. 4). For example, the preliminarily-formed-bodies 40', 40" and 45 are inserted in a metal pattern so as to be pressure-molded. Thus, the flat magnetic powders 50 and the coil 80 are integrally pressure-molded. The coil 80, which is a conductive wire covered by a coating, is resistible to a heat under a predetermined temperature (i.e. maximum temperature). Accordingly, the pressure-molding is required to be performed under a temperature equal to or less than the maximum temperature (for example, 400° C. or less). Moreover, it is preferred to perform the pressure-molding under a temperature (for example, 200° C. or less) defined by the margin of the heat resistance of the coil 80. The magnetic core 20' according to the present embodiment may have a high magnetic permeability even if the magnetic core 20' is formed under the aforementioned low temperature.

As shown in FIG. 4, according to the present embodiment, the wound portion 22' is formed from the preliminarily-formed-body (wound-portion forming body) 45 while the peripheral portion 24' is mainly formed from the preliminarily-formed-bodies 40' and 40". In detail, the preliminarily-formed-bodies 40', 40" and 45 include at least one first preliminarily-formed-body 45 which forms the wound portion 22' and at least one second preliminarily-formed-body 40' or 40" which forms the peripheral portion 24'. Any one of (i.e. at least one of) the second preliminarily-formed-bodies 40' and 40" is other than the first preliminarily-formed-body 45. In other words, the preliminarily-formed-body 45 which constitutes the wound portion 22' is formed separately from the preliminarily-formed-bodies 40' and 40" which constitute the peripheral portion 24'. Moreover, each of the through holes 26' is enclosed by the wound portion 22' and the peripheral portion 24'. In other words, the opposite side surfaces of the wound portion 22' face the respective through holes 26'. As can be seen from the aforementioned structure, the preliminarily-formed-body 45 (i.e. the wound portion 22') is able to be formed so as to have a simple shape around which the coil 80 is easily wound. The inductor 10' according to the present embodiment is formable without winding the coil 80 around the wound portion 22' (i.e. without sewing the two through holes 26' by the coil 80). It is therefore possible to more easily form the inductor 10' even if the inductor 10' has a complicated shape.

The preliminarily-formed-bodies 40', 40" and 45 are arranged so that the upper surface 22*u* of the wound portion 22' of the magnetic core 20' (after pressure-molded) is located below the upper surface 24*u* of the peripheral portion 24' in the upper-to-lower direction while the lower surface 22*b* of the wound portion 22' is located above the lower surface 24*b* of the peripheral portion 24'. Moreover, the preliminarily-formed-bodies 40', 40" and 45 are arranged so that the winding portion 82 of the coil 80 is located between the upper surface 24*u* and the lower surface 24*b* of the peripheral portion 24' in the upper-to-lower direction. Accordingly, it is possible to prevent the wound portion 22' from receiving an excessive pressure when pressure-molded. Moreover, the winding portion 82 of the coil 80 does not protrude from the magnetic core 20' in the upper-to-lower direction so that it is possible to shorten a height (i.e. reduce a size) of the inductor 10'.

As shown in FIGS. 4 to 6, the coil 80 may be partially embedded between two of the preliminarily-formed-bodies 40' and 40". For example, the preliminarily-formed-body 40' and the preliminarily-formed-body 40" may interpose a part of the coil 80. In this case, the end portion 84 of the coil 80 project outward from the magnetic core 20'. Accordingly, the end portion 84 is easily connectable to an outer terminal (not shown).

Figure 7:
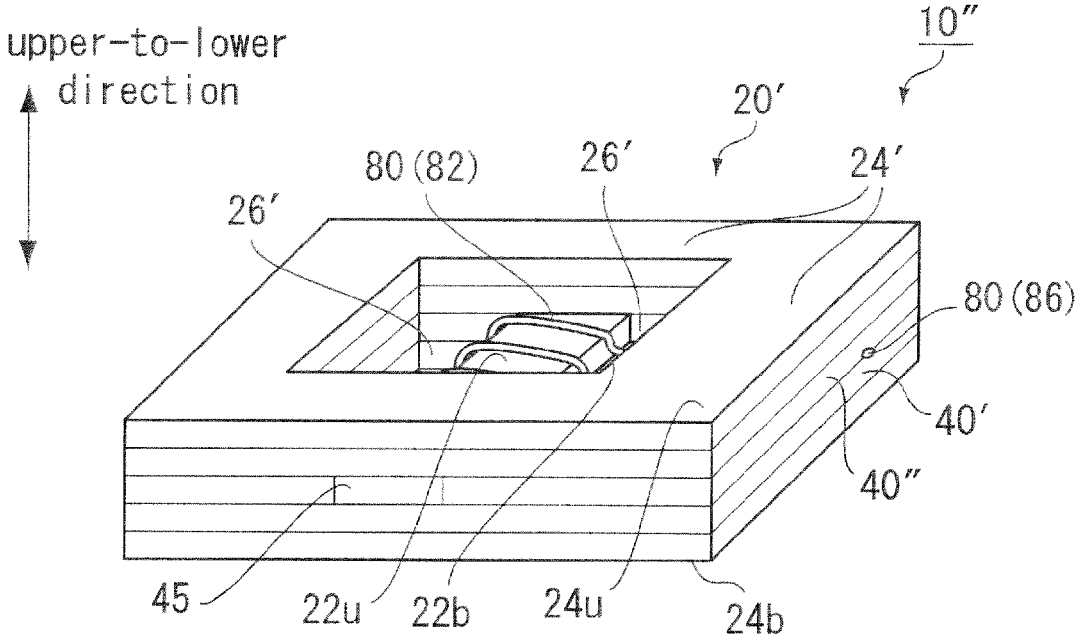
FIG. 7 is a perspective view showing a modification of the inductor of FIG. 4.

As shown in FIG. 7, an inductor 10" according to a modification of the second embodiment comprises a magnetic core 20' and a coil 80 similar to the second embodiment. A part of the coil 80 is embedded between the preliminarily-formed-body 40' and preliminarily-formed-body 40" so as to expose a cutting plane 86 on a side surface of the magnetic core 20'. In other words, the cutting plane 86 of the coil 80 is exposed on the same plane to a surface of the inductor 10". The inductor 10" is thus configured so that the cutting plane 86 is usable as a connecting portion to an outer terminal (not shown). However, the coil 80 may not be embedded within the magnetic core 20'. For example, the end portion 84 of the coil 80 may project outward from the through hole 26' of the inductor 10".

As described above, according to the present invention, it is possible to form a thin inductor from a plurality of thin preliminarily-formed-bodies. Moreover, a coil is woundable around a magnetic core so as to have a central axis parallel to a plane in which flat metal powders are oriented. Accordingly, the inductor may have a sufficient inductance. Moreover, even if the magnetic core has a complicated shape, a preliminarily-formed-body which constitutes a wound portion may be formed so as to have a shape around which the coil is easily wound. Accordingly, even the magnetic core having the complicated shape is formable more easily.

As can be seen from the above description, the inductor according to the present invention shows large effects especially when the magnetic core has a complicated shape (for example, when the magnetic core is formed with a hole through which the coil passes to be wound). However, this invention is applicable to the magnetic core having a simple shape (for example, the magnetic core having a rectangular shape).

EXAMPLES

An inductor according to the aforementioned embodiments of the present invention and a producing method of the inductor will be described below in further detail with reference to several examples.

(Forming of a Preliminarily-Formed-Body)

Gas-atomized powders made of soft magnetic metal were used as material powders. In detail, the used gas-atomized powders were made of Fe—Si—Al alloy (i.e. sendust). Each of the used gas-atomized powders has an irregular particle shape. These material powders had an average grain diameter (D50) of 55 μm.

The material powders were flatten. In detail, the material powders were processed by 8 hours forging by using a ball-mill. After the forging process, the material powders were exposed to 3 hours heat-treatment at 700° C. under a nitrogen atmosphere so that sendust powders having flat shapes (i.e. flat metal powders) were formed. Thus formed flat metal powders had an average major axis (Da) of 60 μm, an average maximum thickness (ta) of 3 μm, and an average aspect ratio (Da/ta) of 20. The average aspect ratio (Da/ta) is obtained as described below. At first, a surface of a cross-section of each of magnetic complexes (i.e. aggregations of the flat metal powders) was sharpened. Then, a scanning electron microscope was used to examine the shapes of the flat metal powders. In detail, the major axes (D) and the thickness (i.e. maximum thickness (t)) at the thickest part of each of the thirty flat metal powders were measured. Then, the average value (Da/ta) of the aspect ratios (D/t) was calculated.

The aforementioned flat metal powders were mixed with a solvent, a viscosity improver and a thermoset binding agent so that a slurry was formed. An ethanol was used as the solvent. A polyacrylic acid ester was used as the viscosity improver. A methyl silicone resin (i.e. an organic binder) was used as the thermoset binding agent.

The aforementioned slurry was applied on a polyethylene-telephthalate (PET) film by using a slot die. Then, the solvent was volatilized by one hour drying at a temperature of 60° C. so that a sheet-like (i.e. planar) preliminarily-formed-body was obtained. When the preliminarily-formed-body was thus formed, the flat metal powders were oriented in the plane of the preliminarily-formed-body without exposed in a specific magnetic field.

(Forming of a Wound Portion of an Inductor of Example 1)

Figure 8A:
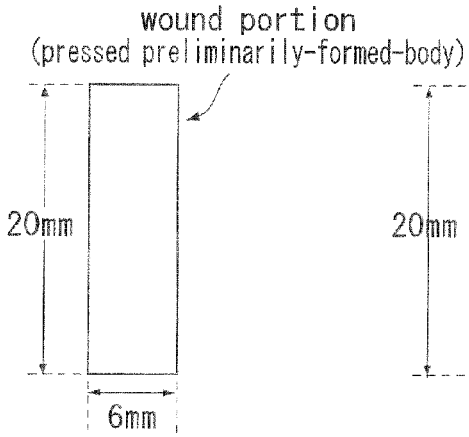
FIG. 8A is a top view showing pressure-molded preliminarily-formed-bodies which form a wound portion of an example inductor of the present invention.

The aforementioned preliminarily-formed-body was cut in a rectangular shape having a width of 6 mm and a length of 20 mm by using a trimming die so that four cut preliminarily-formed-bodies were formed. The four cut preliminarily-formed-bodies were stacked. The stacked preliminarily-formed-bodies were inserted into a metal die to be enclosed by the metal die. The inserted preliminarily-formed-bodies were pressure-molded one hour-long by forming pressure of 20 kg/cm$^2$ at 150° C. As shown in FIGS. 8A and 8B, a pressed preliminarily-formed-body (i.e. the four preliminarily-formed-bodies after pressed) had a thickness of 0.3 mm. This pressed preliminarily-formed-body was used as a preliminarily-formed-body which forms the wound portion of the inductor of Example 1 (i.e. used as the wound portion).

(Forming of a Wound Portion of an Inductor of Example 2)

A pressed preliminarily-formed-body having a width of 6 mm, a length of 20 mm and a thickness of 0.3 mm was formed by the same processes to Example 1 (see FIGS. 8A and 8B). This pressed preliminarily-formed-body was exposed to two hours heat-treatment at 600° C. under a nitrogen atmosphere. The pressed preliminarily-formed-body after the heat-treatment was used as a preliminarily-formed-body which forms the wound portion of the inductor of Example 2 (i.e. used as the wound portion). The wound portion of the inductor of Example 2 was cut in a ring shape. A relative permeability of the ring was measured. The value of the measured relative permeability was 350.

(Forming of a Peripheral Portion of the Inductor of Each of Example 1 and 2)

Figure 8C:
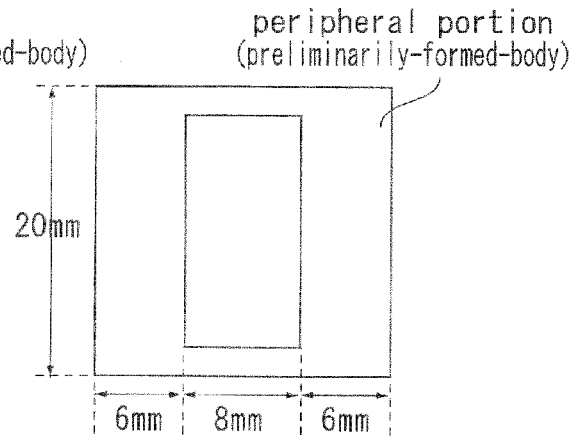
FIG. 8C is a top view showing a preliminarily-formed-body which forms a peripheral portion of the example inductor.
Figure 8B:
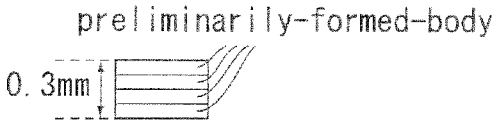
FIG. 8B is a front view showing the pressure-molded preliminarily-formed-bodies of FIG. 8A.
Figure 8D:
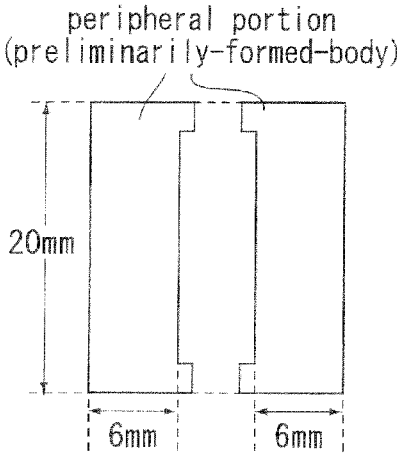
FIG. 8D is a top view showing another preliminarily-formed-body which forms the peripheral portion of the example inductor.

The sheet-like preliminarily-formed-body was cut by using a trimming die so that preliminarily-formed-bodies each having a shape shown in FIG. 8C or 8D were formed. The cut preliminarily-formed-bodies were used as preliminarily-formed-bodies which form the peripheral portion of the inductor of Example 1 or 2 (i.e. used as the peripheral portion).

(Forming of the Inductor of Example 1)

Figure 8E:
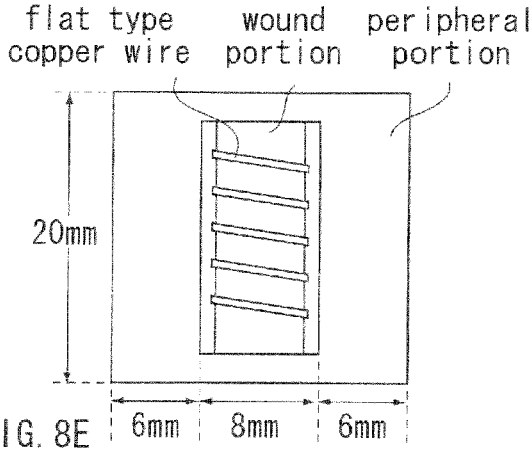
FIG. 8E is a top view showing the example inductor.
Figure 8F:
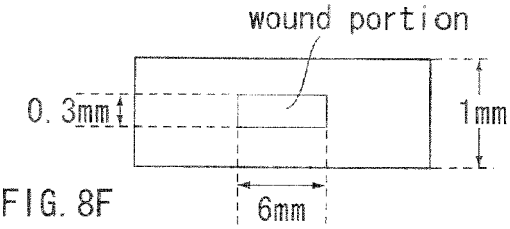
FIG. 8F is a front view showing the example inductor.

A flat type copper wire (i.e. a coil) having a polyimide coating was wound five turns around the wound portion of the inductor of Example 1. The flat type copper wire had a width of 0.8 mm and a thickness of 0.2 mm. The wound portion, around which the flat type copper wire was wound, and the peripheral portion were arranged (i.e. combined) as shown in FIGS. 5 and 6. The combined wound portion and the peripheral portion are placed in a metal die of 20 mm square. In detail, two sets of the preliminarily-formed-bodies each having a shape shown in FIG. 8D were prepared. Each set was comprised of the four preliminarily-formed-bodies. The two sets were placed adjacent to opposite sides of the wound portion, respectively. Similarly, two sets of the preliminarily-formed-bodies each having a shape shown in FIG. 8C were prepared. Each set was comprised of the four preliminarily-formed-bodies. The two sets were placed on and under the wound portion, respectively. Then, the preliminarily-formed-bodies, together with the wound portion around which the flat type copper wire was wound, were pressure-molded one hour-long by forming pressure of 20 kg/cm$^2$ at 150° C. FIGS. 8E and 8F show the shape of the inductor after pressure-molded. As shown in FIG. 8F, the inductor after pressure-molded had a thickness of 1 mm. The inductor was heat-treated so that a molding strain was removed. In detail, the inductor was heat-treated for one hour at 350° C. under a nitrogen atmosphere so that the inductor of Example 1 was formed.

(Forming of the Inductor of Example 2)

The wound portion of the inductor of Example 2 was used so that the inductor of Example 2 was formed by the same processes to Example 1.

(Forming of an Inductor of Comparative Example)

Figure 9A:
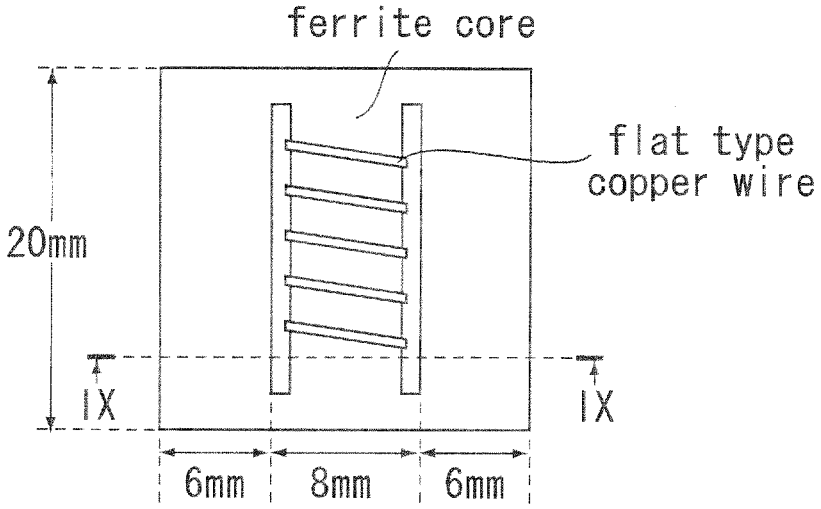
FIG. 9A is a top view showing a comparative example inductor of the present invention.
Figure 9B:
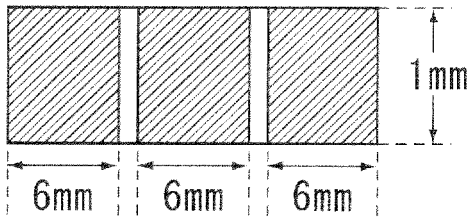
FIG. 9B is a cross-sectional view showing the comparative example inductor of FIG. 9A, taken along lines IX-IX, wherein a coil of the inductor is not illustrated.

A flat type copper wire (i.e. a coil) having a polyimide coating was wound five turns around an EI type ferrite core having a shape shown in FIGS. 9A and 9B so that the inductor of Comparative Example was formed. The flat type copper wire had a width of 0.8 mm and a thickness of 0.2 mm. The ferrite core was a commercial nickel-zinc ferrite core having a relative permeability of 100.

An inductance of each of thus formed inductors of Example 1, Example 2 and Comparative Example was measured in a state where an electric current of 1 MHz was flown to the coil of the inductor. The measurement results are shown in Table 1.

TABLE 1

| | inductance (μH) |
|---|---|
| Example 1 | 2.0 |
| Example 2 | 2.5 |
| Comparative Example | 2.0 |

As shown in Table 1, although the inductor of Example 1 was produced by pressure-molding the metal powders, the inductor of Example 1 has the same inductance to the inductor of Comparative Example which was produced by using the nickel-zinc ferrite having the relative permeability of 100. Meanwhile, the inductor of Example 2, which was produced by pressure-molding the metal powders similar to Example 1, has the inductance more than the inductance of the inductor of Comparative Example.

One of the reasons of the high inductance of the inductor of Example 1 or 2 is that the preliminarily-formed-bodies were placed around the wound portion so as to prevent the wound portion from receiving the pressure. The pressure was not applied to the wound portion so that the magnetic permeability of the wound portion was not lowered by the pressure-strain. One of the reasons of the higher inductance of the inductor of Example 2 is that the wound portion was heat-treated at high temperature to have the improved magnetic permeability.

The present application is based on a Japanese patent applications of JP2011-250663 filed before the Japan Patent Office on Nov. 16, 2011, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. An inductor comprising:

a magnetic core having a wound portion and a peripheral portion, the magnetic core being formed by pressure-molding a plurality of preliminarily-formed-bodies each having a plate-like shape parallel to a predetermined plane, the plurality of preliminarily-formed-bodies including at least one first preliminarily-formed-body which forms the wound portion and at least one second preliminarily-formed-body which forms the peripheral portion, wherein the at least one second preliminarily-formed-body is other than the at least one first preliminarily-formed-body, and the at least one second preliminarily-formed-body does not form the wound portion, wherein each of the plurality of preliminarily-formed-bodies is formed from a mixture of flat magnetic powders and an organic binder, each of the flat magnetic powders being oriented so as to be substantially parallel to the predetermined plane; and a coil wound around the wound portion, wherein the plurality of preliminarily-formed-bodies are pressure-molded in a state where the coil is wound around the at least one first preliminarily-formed-body, wherein the magnetic core is formed without any holes except for through holes for winding the coil;

wherein the magnetic core is formed by pressure-molding the plurality of preliminarily-formed-bodies which are stacked in an upper-to-lower direction perpendicular to the predetermined plane;

wherein the peripheral portion has an upper surface and a lower surface in the upper-to-lower direction, each parallel to the predetermined plane; and wherein the wound portion has an upper surface and a lower surface in the upper-to-lower direction, wherein the upper surface of the wound portion is located below the upper surface of the peripheral portion in the upper-to-lower direction, and the lower surface of the wound portion is located above the lower surface of the peripheral portion in the upper-to-lower direction.

2. The inductor as recited in claim 1, wherein:

each through hole pierces the magnetic core in the upper-to-lower direction perpendicular to the predetermined plane;

each through hole is enclosed by the wound portion and the peripheral portion in a plane parallel to the predetermined plane; and the coil passes through each through hole so as to be wound around the wound portion.

3. The inductor as recited in claim 1, wherein the coil has a winding portion which winds around the wound portion, and wherein the winding portion is located between the upper surface of the peripheral portion and the lower surface of the peripheral portion in the upper-to-lower direction.

4. The inductor as recited in claim 1, wherein the coil is partially embedded between two of the plurality of preliminarily-formed-bodies.

5. The inductor as recited in claim 1, wherein the wound portion is formed from a wound-portion forming body, the wound-portion forming body being formed by pressure-molding the at least one first preliminarily-formed-body before the coil is wound.

6. The inductor as recited in claim 5, wherein the wound-portion forming body is formed by heat-treating the at least one first pressure-molded preliminarily-formed-body at 300° C. or more before the coil is wound.

7. The inductor as recited in claim 1, wherein the coil is a coated flat type copper wire.

8. The inductor as recited in claim 1, wherein the flat magnetic powders comprise a plurality of metal powders each having a flat shape.

9. The inductor as recited in claim 1, wherein the coil is wound around the wound portion so as to have a central axis parallel to the predetermined plane.

10. The inductor as recited in claim 1, wherein a magnetic path, which is generated when a current flows in the coil, mostly extends along an axis of easy magnetization of the magnetic core.

* * * * *